US009258646B2

(12) United States Patent
Hillman et al.

(10) Patent No.: US 9,258,646 B2
(45) Date of Patent: Feb. 9, 2016

(54) SELF-POWERED AUDIO SPEAKER HAVING MODULAR COMPONENTS

(75) Inventors: Jim Hillman, Sherwood, OR (US); Jay Eisenlohr, Portland, OR (US)

(73) Assignee: Slotius, LLC, Portland, OR (US)

( * ) Notice: Subject to any disclaimer, the term of this patent is extended or adjusted under 35 U.S.C. 154(b) by 806 days.

(21) Appl. No.: 12/981,449

(22) Filed: Dec. 29, 2010

(65) Prior Publication Data

US 2011/0158424 A1 Jun. 30, 2011

Related U.S. Application Data

(60) Provisional application No. 61/291,604, filed on Dec. 31, 2009.

(51) Int. Cl.

| | |
|---|---|
| ***H04R 1/02*** | (2006.01) |
| ***H04R 9/06*** | (2006.01) |
| ***H04R 3/12*** | (2006.01) |
| *H04R 3/14* | (2006.01) |

(52) U.S. Cl.

CPC .. *H04R 3/12* (2013.01); *H04R 3/14* (2013.01); *H04R 2205/021* (2013.01); *H04R 2499/11* (2013.01)

(58) Field of Classification Search

CPC ..... H04R 13/02; H04R 1/02; H04R 1/06; H04R 1/1028; H04R 5/02; H04R 9/06; H04R 2205/021; H04R 2499/11

USPC ..... 381/80, 111, 116, 117, 99, 77, 79, 82, 381/333, 334, 118, 386–388, 394, 395; 700/94; 361/679.23, 679.41

See application file for complete search history.

(56) References Cited

U.S. PATENT DOCUMENTS

| | | | | |
|---|---|---|---|---|
| 6,278,678 | B1 * | 8/2001 | Iida | 369/83 |
| 7,095,867 | B2 * | 8/2006 | Schul et al. | 381/334 |
| 2002/0000831 | A1 * | 1/2002 | Smith | 326/39 |
| 2002/0003889 | A1 * | 1/2002 | Fischer | 381/370 |
| 2004/0039462 | A1 * | 2/2004 | Chen | 700/94 |
| 2004/0117521 | A1 * | 6/2004 | Chen et al. | 710/62 |
| 2004/0122540 | A1 * | 6/2004 | Allred | 700/94 |
| 2006/0161964 | A1 * | 7/2006 | Chung | 725/141 |
| 2008/0032663 | A1 * | 2/2008 | Doyle | 455/345 |

OTHER PUBLICATIONS

International Search Report mailed Mar. 21, 2011 corresponding to International Application No. PCT/US2011/020059.

* cited by examiner

*Primary Examiner* — Xu Mei
(74) *Attorney, Agent, or Firm* — Marger Johnson

(57) ABSTRACT

Embodiments of the invention include a speaker system having the ability to accommodate one or more transmission protocols as well as multiple upgrade paths. One or more replaceable cards sit in a socket or bus system. The cards may include one or more components for receiving a wireless audio signal and decoding the signal. Other cards may include circuits for converting the digital audio signals into analog audio signals. Yet other cards, or other components on cards, may include circuitry for filtering or modifying the audio signals. In some embodiments the main components of the cards may be formed in a re-programmable device that can be updated by a user. In conjunction, these components create a powered speaker system that is constantly upgradeable as various data transmission standards and audio filtering standards mature.

14 Claims, 6 Drawing Sheets

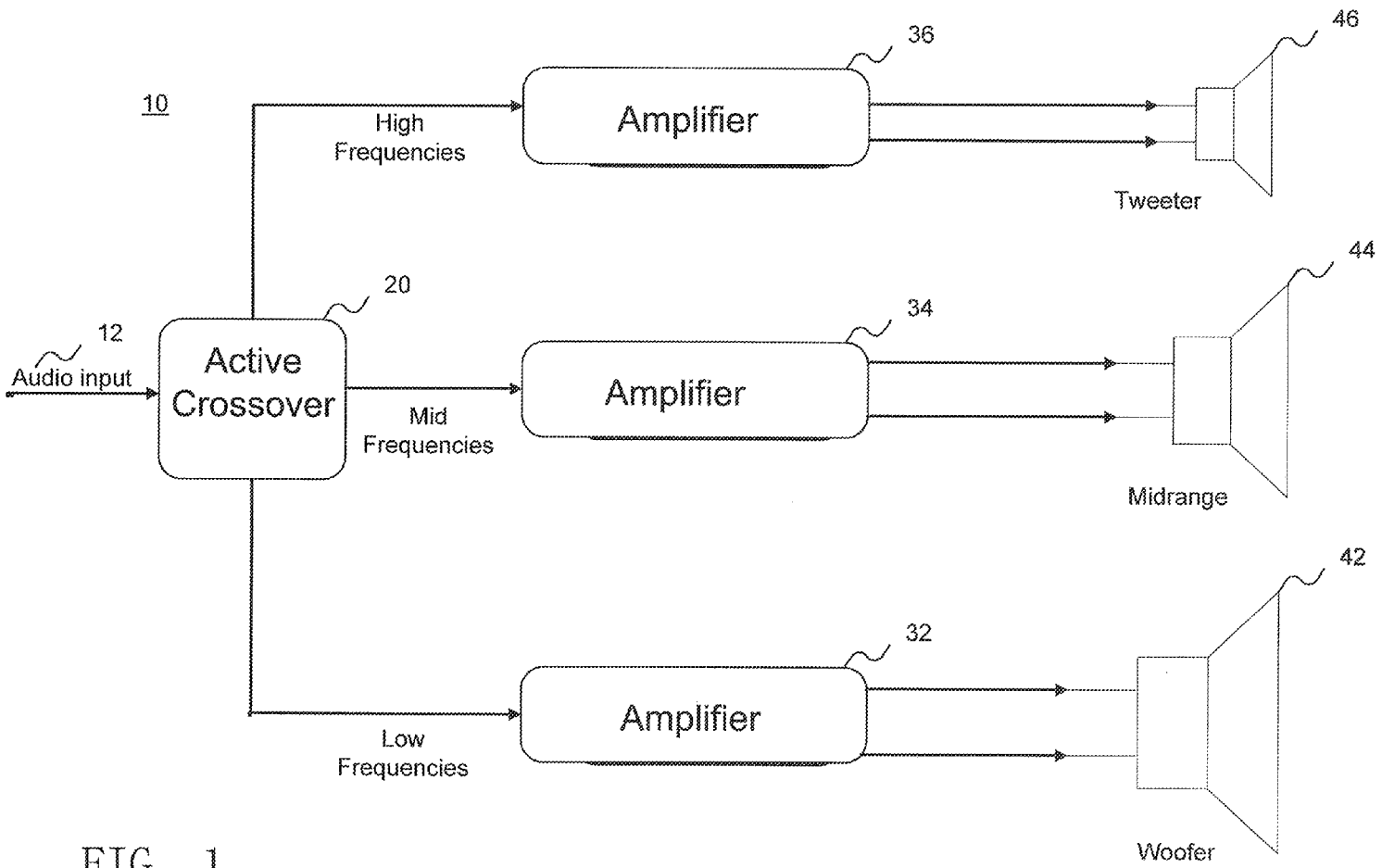
FIG. 1
(Conventional)

| Example Pin Diagram | |
|---|---|
| | |
| 1 | 3.3 volts |
| 2 | ground |
| 3 | 5 volts |
| 4 | ground |
| 5 | 12 volts |
| 6 | ground |
| 7 | line level input pos |
| 8 | line level input neg |
| 9 | balance ground |
| 10 | line level output 0 pos |
| 11 | line level output 0 neg |
| 12 | balance ground 0 |
| 13 | line level output 1 pos |
| 14 | line level output 1 neg |
| 15 | balance ground 1 |
| 16 | line level output 2 pos |
| 17 | line level output 2 neg |
| 18 | balance ground 2 |
| 19 | line level output 3 pos |
| 20 | line level output 3 neg |
| 21 | balance ground 3 |
| 22 | serial digital 1 data |
| 23 | serial digital 1 clk |
| 24 | serial digital 1 clk2 |
| 25 | serial digital 1 master clk |
| 26 | serial digital 1 upload data |
| 27 | serial digital 1 data ground |
| 28 | Strap for crossover |
| 29 | Strap for crossover |
| 30 | ground |
| 31 | ground |

FIG. 7

SELF-POWERED AUDIO SPEAKER HAVING MODULAR COMPONENTS

CROSS REFERENCE TO RELATED APPLICATIONS

This application claims the benefit of U.S. Provisional Application 61/291,604, entitled SELF-POWERED AUDIO SPEAKER HAVING MODULAR COMPONENTS, filed Dec. 31, 2009, the contents of which are incorporated by reference herein.

BACKGROUND

A typical home audio system has one or more input sources coupled to an amplifier or receiver, which in turn is coupled to a set of speakers. In operation, an audio signal generating source, such as a CD (Compact Disc) player is connected to an amplifier input through an input cable. The CD player reads information from the disk, generates an audio signal from the information, and sends a low-level or line-level audio signal to the amplifier over the input cable. The amplifier, in turn, amplifies the signal and drives various speaker outputs that are in turn connected to speakers by speaker wires.

Although twenty years ago home audio systems typically included only two speakers, present "surround" systems now include five or seven speakers for the main audio plus a subwoofer to produce low frequency effects. Commercial applications, such as retail stores or shopping malls may include dozens or hundreds of speakers. Connecting such large number of speakers generally requires a commensurate number of speaker wires originating from the amplifier. Although commercial facilities may be designed with structures equipped to distribute speaker wires, along with other electrical distribution, homes are generally not so equipped. Instead, a typical home includes wires for electrical distribution hidden within walls that are covered by solid wall coverings during construction. It is very difficult to add additional wires within walls once a home is constructed, and thus exposed speaker wire is often an unsightly, though necessary, requirement for most home audio installations.

There have been developments with "powered" audio speakers, which typically include integral amplification and active crossover networks, but these systems lie at the periphery of mainstream home audio. One type of powered speaker that is pervasive in home audio is a powered sub-woofer. Other powered systems include desktop computer speakers, docking systems for personal audio devices, professional audio speakers, and "pro-sumer" monitor speakers.

There have also been some developments with powered "wireless" audio speakers, but these systems are generally proprietary "closed loop" systems, including a particular transmitter being required to operate with a particular receiver. Requiring such matched systems frustrates many consumers of audio products because it generally binds them to purchasing pre-packaged systems, which lack flexibility and may not meet requirements of many consumers. In addition, current wireless speaker systems tend to be small, inexpensive, and characterized by low fidelity.

Embodiments of the invention address these and other limitations of the prior art.

BRIEF DESCRIPTION OF THE DRAWINGS

FIG. 1 is a functional block diagram of a conventional three-way active speaker system.

FIG. 7 is a pin-out diagram illustrating example power and signals that may be used within speakers according to, embodiments of the invention.

DETAILED DESCRIPTION OF THE EMBODIMENTS

Figure 2:
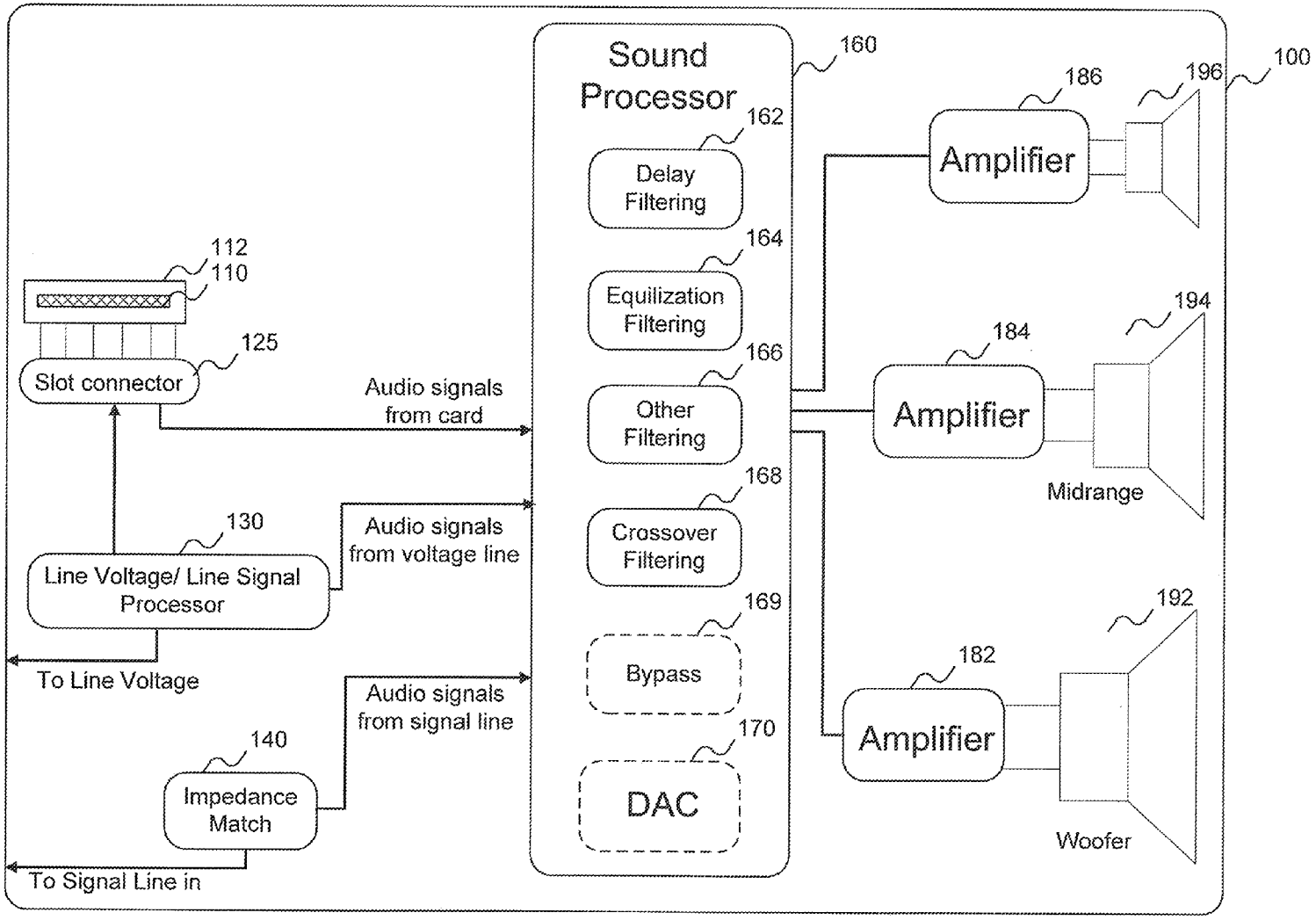
FIG. 2 is a functional block diagram of an active speaker system according to embodiments of the invention.

FIG. 1 is a functional block diagram of a conventional three-way active speaker system. The system 10 includes a signal input 12, which may be a balanced or un-balanced low or line-level signal from an audio component. The signal input 12 is coupled to an active crossover 20, which separates the various frequencies from the composite frequencies carried by signal input 12. The active crossover 20 includes high pass, bandpass, and low pass filters to separate the composite frequencies into distinct low frequencies, middle frequencies and high frequencies. The low frequencies are fed to an amplifier 32, which in turn is coupled to a woofer 42. The mid frequencies from the active crossover 20 are fed to an amplifier 34, which in turn is coupled to a midrange speaker 44. The high frequencies are fed to an amplifier 36, which drives a tweeter 46. In operation, the original signal from the audio signal input 12 is split by the active crossover 20, then separately amplified by the amplifiers 32, 34, 36, and sent to the respective separate speakers 42, 44, 46, re-creating the music or other sounds that were used to create the original input signal.

FIG. 2 is a functional block diagram of an active speaker system 100 according to embodiments of the invention. Conceptually, in this embodiment, the differences from the prior art speaker of FIG. 1 are primarily found in the signal-receiving portion of the system 100. Thus, amplifiers 182, 184, and 186, as well as speakers 192, 194, and 196, are functional equivalents to the same components of FIG. 1.

The crossover function of the crossover 20 of FIG. 1 is preserved, but, instead of a stand-alone crossover, the crossover function is one of a number of filtering functions that may be performed by a sound processor 160. The sound processor 160 receives an audio signal in one of a number of ways described in detail below. After receiving the audio signal at one of its inputs, the sound processor 160 modifies the audio signal through one or more filters. The filtering functions are separately illustrated in FIG. 2, but, in practice, may be combined into one or more combined filters, as is known in the art. In some embodiments the sound processor functions may be eliminated or bypassed completely.

Examples of the filtering performed by the sound processor 160 include delay filtering 162, equalization filtering 164, and crossover filtering 168. Other filters may be present as well, illustrated as filter 166. The filters 162-168 may be modified by user-controllable inputs, or the filtering may be fixed, and not user modifiable.

The audio signal input to the sound processor 160 may be in either digital or analog form, and likewise its output to the amplifiers 182, 184, 186 may be digital or analog. The sound processor 160 may filter the audio signal with either digital filtering or analog filtering, as is known in the art. A Digital to Analog Converter (DAC) 170, if necessary, changes digital audio data into analog audio signals. The amplifiers 182, 184, 186, are typically analog amplifiers that expect an analog signal. Therefore, the DAC 170 converts the digital audio signal to an analog signal before sending it to the connected amplifiers 182, 184, 186. When the filters 162-168 are digital filters, the DAC 170 is located at the end of the filtering datapath to convert the final filtered signal to the analog signal for the amplifiers 182, 184, 186. Instead, when the filters 162-168 are analog filters, and when the input signal to the sound processor 160 is a digital signal, the DAC 170 is located in the beginning of the datapath to convert the input digital audio signals to analog signals before filtering using the analog filters.

Although typically the amplifiers 182, 184, 186 are analog signal amplifiers, they may instead be capable of receiving a digital audio signal, such as Class D amplifiers. In such a case, the DAC 170 may not be used at all, and the digital outputs of the filters of the sound processor 160 may be passed directly to the amplifiers 182, 184, 186. The digital signal is used to derive a binary waveform using, for example, pulse width modulation (PWM) as is known in the art. The binary waveform may then be amplified and passed to the speakers 192, 194, 196 to generate the desired sound output.

Figure 3:
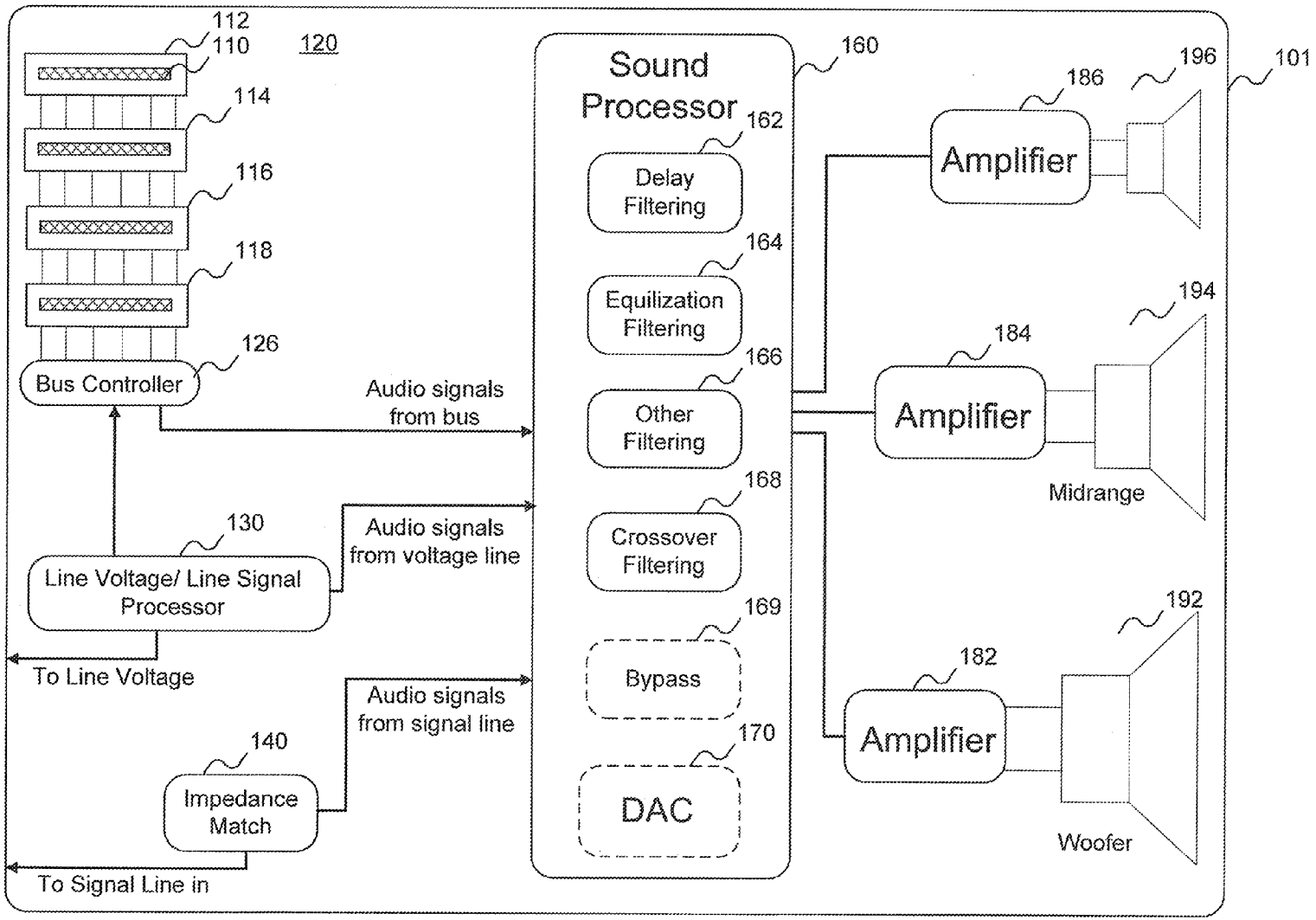
FIG. 3 is a functional block diagram of another active speaker system according to embodiments of the invention.

The sound processor 160 may be embodied by any known technology for performing the included filtering functions, such as one or more Digital Signal Processors (DSPs), one or more Application Specific Integrated Circuits (ASICS), one or more programmed microprocessors, or conventional combination circuitry. Further, although only a single sound processor 160 is illustrated in FIGS. 2 and 3, the sound processing function may be different for various channels in the speaker 100.

Rather than the single signal input 12 of FIG. 1, audio signals are acquired by the speaker system 100 of FIG. 2 in any of a number of ways. Specifically, and similar to the conventional design, the speaker system 100 may be connected to a signal line through a wired signal line input. The signal line may be a standard line level audio input, such as that from a CD player. Alternately, the signal line may be a high level, amplified signal. Depending on the particular input signal, an impedance matching circuit 140 may be employed to match the signal level of the connected audio signal to the signal expected by the sound processor 160.

In another embodiment, the audio signal may be received through a standard power plug that also accepts the line voltage to power the components of the speaker 100. In such a system a transmitter (not shown) places the audio signals on the standard AC power lines of a house, which is connected to the speaker system 100 by the standard power cord. The audio signals are detected and isolated by a line signal processor 130, which in turn sends the audio signals to the sound processor 160. The audio signals on the power lines may accord to one or more standards that are established for such purposes. One such standard is the Home Plug Alliance, in which case the line signal processor 130 is embodied by a Home Plug Alliance AV transceiver.

In addition to receiving the audio signal from the power line, the line voltage processor 130 converts the line voltage into various regulated AC and DC voltage power sources for use by the speaker 100. Example DC voltages include 3.3 v, 5 v, and 12 v, which may be used by the components with the speaker system 100. Other components may use AC signals at reduced voltages from 120 volts, such as the amplifiers 182, 184, 186, in which case the power portion 120 may include one or more step-down transformers.

Yet another method to send audio signals to the speaker system 100 is to send such signals wirelessly. In such an embodiment a transmitter (not shown) transmits audio signals wirelessly to a receiver located in the speaker 100. The receiver sits on a card, or line card, described below, which itself sits in a socket 110 of a card slot 112. A slot connector 125 couples signals from the card and card slot 112 to the sound processor 160.

FIG. 3 is a block diagram of a speaker system 101, which in most respects is identical to the speaker system 100 of FIG. 2, and therefore the common components will not be separately described. Whereas the speaker system 100 of FIG. 2 includes a single socket 110 for receiving a card, the speaker system 101 includes multiple card slots 114, 116, and 118, arranged in a bus 120. In this embodiment the bus 120 is controlled by a bus controller 126, which also includes an interface to the sound processor 160.

In operation, more than one card may be placed in respective card slots in the bus 120, and each card may be specific to receiving a particular protocol. For example, the speaker system 101 may include a card in slot 114 specific to receive "protocol A," and another card in slot 116 specific to receive "protocol B." Then, Protocol A or Protocol B may be selected depending on which Protocol is active, and the corresponding audio signal appropriately processed and propagated. The sounds reproduced by the speaker system 101 are those originating from the active source signal path in the speaker system that are in turn processed through the sound processor 160 and amplified for the speakers.

Figure 4:
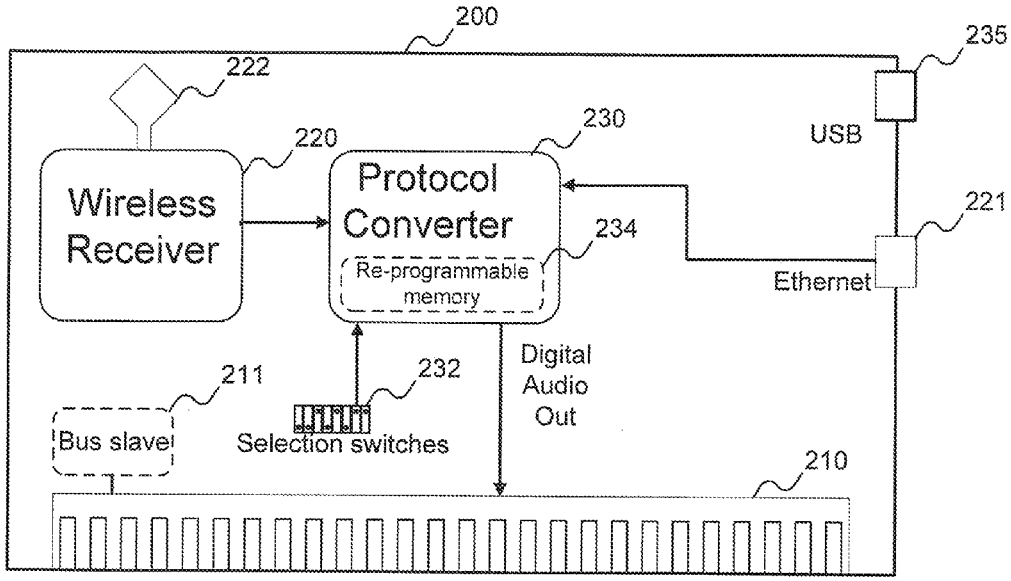
FIG. 4 is a block diagram illustrating a receiving line card that can be used in conjunction with the speaker system according to embodiments of the invention.

FIG. 4 is a block diagram illustrating a line card or receiver card 200, which sits in one of the card slots 112-118 of FIG. 2 or 3. The receiver card 200 is generally made of PC (Printed Circuit) material and is rigid and relatively strong so that it can be inserted into the card slot 112-118 without breaking. The card slots 112-118 may include clips, screws, or other attachment means to secure the card 200 into the bus. The receiver card 200 additionally includes connections 210 that electrically interface with the socket 110 of FIG. 2 or within bus 120 of FIG. 3. The connections 210 include paths for any necessary power and ground reference, as well as signals for audio data. For speaker systems that include the bus 120, and bus controller 126 of FIG. 3, a bus slave 211 is present on the card 200 to control data traffic received from or sent to the bus 120. Various bus protocols and standards may be established for compatibility with other card manufacturers and other products that are compatible with the speaker systems 100 and 101, FIG. 2 and FIG. 3 respectively.

In other embodiments the card 200 may take the form of a module that may be inserted into a drawer structured to accept the module. In other embodiments the card 200 may take the form of a USB thumb drive or other device readily removable and replaceable device. In other embodiments the receiver card 200 can be any device that can be updated or replaced in a matching receiving system housed in the speaker system 100, 101. In addition to the hardware solutions described above, the receiver "card" may instead be software codes that may be selectively activated to cause the speaker system 100, 101 to receive a particular audio channel.

The receiver card 200 includes a wireless radio receiver 220, which is coupled to an antenna 222. Generally, the radio receiver 220 receives a signal from a radio transmitter (not illustrated) that carries audio signals for amplification by the speaker systems 100, 101. Although in some embodiments it is possible to receive a signal directly in analog form, generally embodiments of the invention receive data that is transmitted in digital form. In theory, signals may be transmitted on any base band radio frequency, but federal spectral frequency allocations have promoted standardizations in data transmission in particular unlicensed frequency bands. It is expected that the radio receiver 220 receives signals on the 900 MHz, 2.4 GHz and/or 5.8 GHz standard data-transmitting frequencies. However, should data transmission over other frequencies be employed, the speaker systems 100, 101 are upgradeable by simply replacing the receiver card 200 with a new receiver card that includes a new wireless radio receiver tuned to the new frequency, or by using other updating methods. In other embodiments, audio data may be transmitted to the speaker systems 100, 101 over licensed spectra, such as cell phone networks or other similar data networks. The wireless data is received at the speaker system 100, 101 through a wireless receiver. Then the audio data is extracted, optionally processed, and amplified for speaker output as described in detail below.

When the radio receiver 220 receives digital data on its target frequency, such data must be translated into useful information to re-create the desired audio signal for amplification by the speaker systems 100, 101. For translating purposes, the radio receiver 220 is coupled to a protocol decoder 230. The decoder 230 de-codes the raw data received by the radio receiver 220 according to one or more of standardized data protocols to re-create the original data sent by the data transmitter. For example, the decoder 230 may receive data formatted in a proprietary 2.4 GHz protocol of AVNERA, with the output data appropriately decoded. In some embodiments the decoded data may then be placed directly on the socket 110 (FIG. 2) or bus 120 (FIG. 3), through the connections 210, for use by other components of the speaker systems 100, 101.

Other data protocols that the decoder 230 may decode include those listed in Table 1.

TABLE 1

| |
|---|
| 2.4 GHz proprietary: |
| Avnera |
| STS |
| Nortic |
| Kleer |
| Eleven Engineering |
| 5.x GHz proprietary: |
| Focus Enhancements |
| NeoSonik, |
| Amimon |
| 2.4 and 5.8 GHz Wifi: |
| Squeeze Box |
| Play To |
| Air Play |
| BridgeCo |
| Sonos |
| DLNA |

One of the most useful features of the powered speaker systems 100, 101 is that it can always be updated to accept any new protocol, or another chip or module for an existing protocol, that is developed after the speaker design has been completed, just by replacing the receiver card 200 to match the sending protocol.

In some embodiments the decoder 230 includes multiple protocols which may be automatically selected, or selected by the user to match the transmitting protocol. For example the user may set a switch code on DIP Switch 232 (Dual In-line Package Switch) that matches the transmitting code. Other embodiments may scroll through the protocols one by one until the proper code is either detected automatically or selected by a user.

For even easier upgradability, the protocol converter 230 may be implemented in or contain a re-programmable device, such as FLASH memory, FPGA or other re-programmable device 234. In such an embodiment updating the protocol converter 230 to a new protocol is accomplished by placing the receiver card 200 in an appropriate device, such as a personal computer having a compatible slot, then running an updating program on the computer. The updating program may reset the re-programmable protocol converter 230 to a like-new condition, then re-program the converter for the updated signal. Other updating functions may include updates sent over the Internet to designated Media Access Control (MAC) addresses, or selecting one or more of existing protocols already present on the protocol converter 230, through a selection function such as a menu or other selectors. Because all users may not have a compatible computer or may not be comfortable with inserting the receiver card 200 into their own computer, the receiver card 200 may include another interface, such as a USB (Universal Serial Bus) interface through which the re-programmable protocol converter 230 may be re-programmed. In this embodiment the user places a USB connector into a USB receiving port 235 on the receiver card 200, which may not even require removal from the bus 120. The other end of the USB connector is then connected to a computer or other device. The user then runs the updating program on the connected device, which updates the protocol converter 230 through the USB bus. In yet other embodiments the protocol connector 230 may be able to be upgraded wirelessly through the Internet or otherwise by receiving the programming information through the wireless receiver 220.

For embodiments where there is too much radio interference or for other reasons where a wireless signal is not desirable, data containing the audio data may be transmitted to the speaker system 100, 101 over a data cable. For instance, cards 200 and 300 of FIGS. 4 and 5, respectively each include an Ethernet port through which data signals according to the Ethernet protocol may be received. In such an example embodiment the protocol converter 230, 330 may convert the data signals received over the Ethernet cable into audio signals for processing. Of course, Ethernet is but one example of a wired protocol over which audio data may be transmitted to the speaker system 100, 101.

Figure 5:
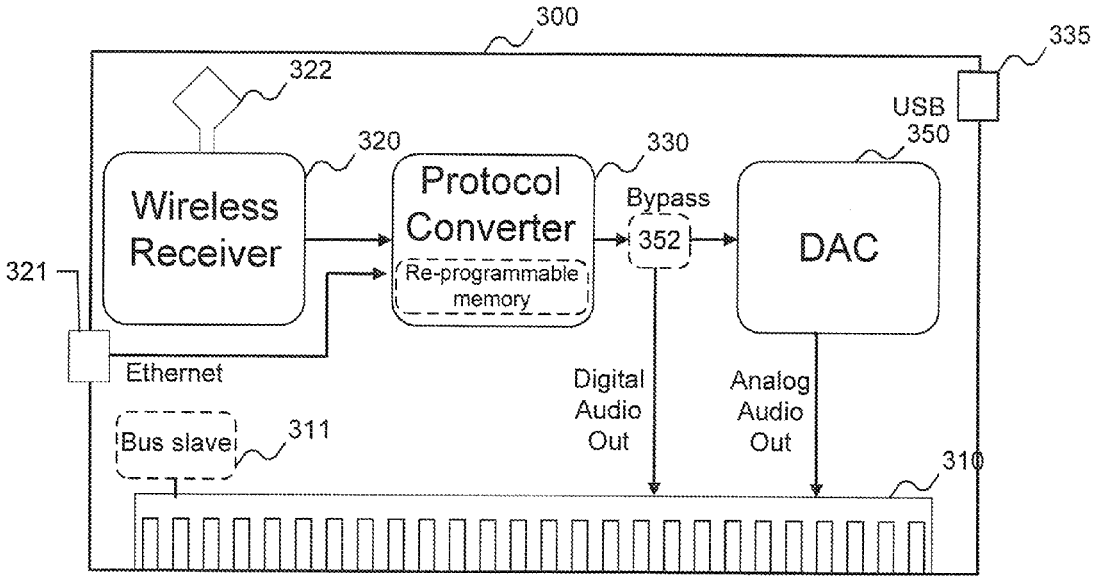
FIG. 5 is a block diagram illustrating another receiving line card that can be used in conjunction with the speaker system according to embodiments of the invention.

FIG. 5 is a block diagram illustrating another line card 300, which is similar in most respects to the line card 200 of FIG. 4. The features common to the cards 200, 300 are not separately described. In addition to the features of the card 200, the line card 300 of FIG. 5 further includes its own DAC 350 that converts the digital data from the protocol converter 330 to analog audio signals, before placing the audio signals on the socket 110 or bus 120 through a set of connections 310. A speaker system 100, 101 that uses digital audio signals on the socket 110 or bus 120 would use the card 200, whereas a speaker system 100, 101 that uses analog signals on the socket 110 or bus 120 would use the card 300. In some embodiments the DAC 350 of FIG. 5 may be able to be turned on or off, or bypassed, such as by using a bypass circuit 352, so that a single card 300 is capable of providing either type of signal, digital or analog, to the socket 110 or bus 120.

Figure 6:
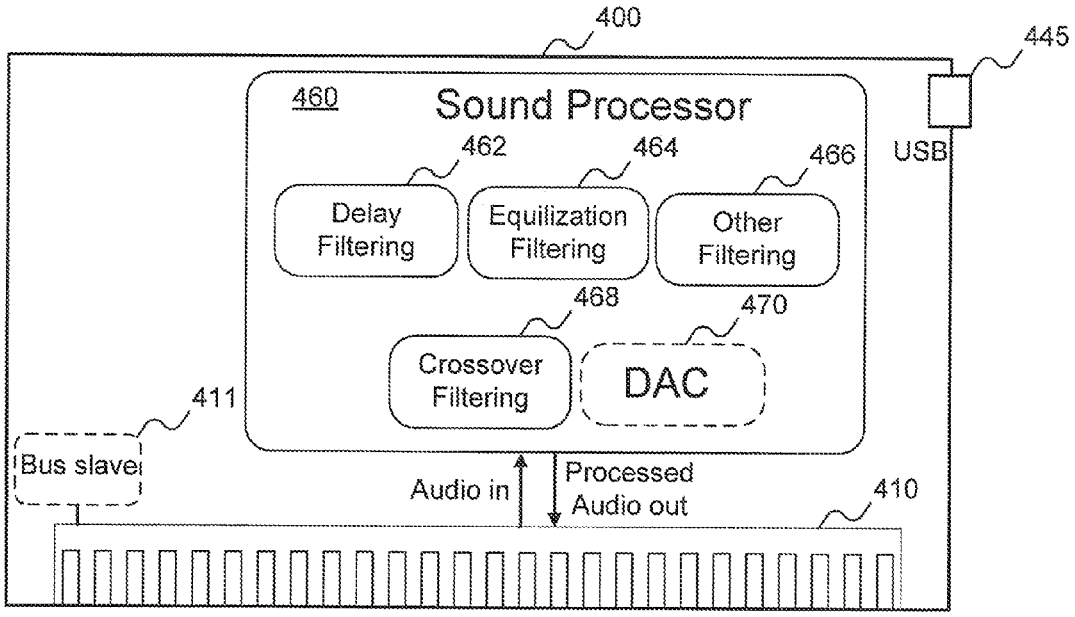
FIG. 6 is a block diagram illustrating a sound processing line card that can be used in conjunction with the speaker system according to embodiments of the invention.

FIG. 6 is a block diagram illustrating a sound processing line card 400, which may be used in conjunction with either of the receiver line cards 200, 300 described above. Like the receiver cards 200, 300, the sound processing card 400 is a relatively rigid PC card for insertion into slots within the bus 120 of FIG. 2. The sound processing card 400 likewise includes connections 410 that electrically interfaces with the socket 110 of FIG. 2 or within bus 120 of FIG. 3. Such connections 410 include paths for any necessary power and ground reference, as well as signals for audio data. A bus slave 411 interfaces with the bus controller 126 to control data flowing to and from the bus 120. In particular, the sound processing card 400 accepts the audio signals from the electrical connections 410.

After the audio signals have been received by the sound processing card 400 they are passed to a sound processor 460 which filters the audio using one or more filters. The sound processor 460 may perform the same or similar function or functions as the sound processor 160 of FIGS. 2 and 3. Of course, the functions need only be performed once, so, embodiments of the invention that include the sound processing card 400 will generally include a mechanism to bypass or turn off the sound processor 160 of FIGS. 2 and 3, such as the bypass circuit 169. In some embodiments the bus controller 126 may detect the presence of the sound processing card 400 and automatically bypass the sound processor 160.

Further, similar to the protocol converter 230, 330 described above, the sound processor 460 may be implemented in a re-programmable device, so that the filtering functions can be constantly updated using the re-programming techniques described above, which may or may not include using a USB port 445.

Although the sound processing card 400 and the receiving cards 200, 300 are functionally shown as separate cards, they may, in fact, be combined into a single card.

FIG. 7 is a diagram and pin-out chart of an example connector that may be used within the speaker systems 100, 101. For example, a plug and socket may be used to couple signals from the slot controller 125 or bus controller 126 to the sound processor 160. These pin-outs may correspond directly to signals from the socket 110, bus 120, or their respective connectors 125, 126 may translate the signals from the slot 112 (or bus 120) into the pin-outs listed in FIG. 7.

Although various implementation details have been described above, deviations from these details may be made while still in the scope of the inventive concepts disclosed herein.

What is claimed is:

1. A speaker for projecting audio sounds, comprising:

a first socket structured to accept one or more electrical devices, each socketed electrical device configured to decode audio signals according to a different particular wireless protocol from data signals sent from a transmitter to the speaker;

a second socket coupled to the first socket through a bus, the second socket also structured to receive one or more socketed electrical devices;

a bus controller structured to regulate the socketed electrical devices that are respectively socketed in the first socket or the second socket;

a sound processing unit coupled to the socket and structured to receive the decoded audio signals and selectively modify the decoded audio signals; and one or more individual speaker components structured to receive the modified audio signals and generate the audio sounds.

2. The speaker of claim 1 in which the first socket is a slot configured to accept a single card.

3. The speaker of claim 1 in which one or more electrical devices comprise re-configurable memory.

4. The speaker of claim 1 in which the sound processing unit includes a bypass function.

5. The speaker of claim 1 in which the data signals are wireless signals transmitted according to a WiFi standard.

6. The speaker of claim 1 in which the data signals are transmitted according to a proprietary protocol.

7. The speaker of claim 1 in which the data signals are received through a wired data connection.

8. The speaker of claim 7 in which the data signals accord to an Ethernet protocol.

9. The speaker of claim 8, further comprising a detector structured to detect an active audio signal for operation by the speaker.

10. The speaker of claim 1, further comprising a power line receiver structured to accept an audio signal in addition to operational power for the speaker system.

11. The speaker of claim 8, further comprising a selector structured to select an active audio signal for operation by the speaker.

12. The speaker of claim 1, further comprising an audio line input structured to accept an audio signal.

13. The speaker of claim 1 in which the first socket is structured to accept a first socketed electrical device with a first particular wireless protocol, and the second socket is structured to accept a second socketed electrical device with a second particular wireless protocol different than the first wireless protocol.

14. The speaker of claim 13, further comprising:

a detector structured to detect an active audio signal for operation by the speaker; and a selector structured to select either the first particular wireless protocol or the second particular wireless protocol based on the detected active audio signal.

* * * * *